US006976833B2

(12) United States Patent
Daniels et al.

(10) Patent No.: US 6,976,833 B2
(45) Date of Patent: Dec. 20, 2005

(54) COMPRESSOR DISCHARGE CHAMBER WITH BAFFLE PLATE

(75) Inventors: Mark A. Daniels, LaCrosse, WI (US); Lee G Tetu, Baldwinsville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 10/715,200

(22) Filed: Nov. 17, 2003

(65) Prior Publication Data

US 2005/0106054 A1 May 19, 2005

(51) Int. Cl.[7] ..... F03C 2/00

(52) U.S. Cl. ..... 418/197; 418/201.1; 417/312; 181/403

(58) Field of Search ..... 418/197, 201.1; 417/312; 181/403

(56) References Cited

U.S. PATENT DOCUMENTS 1,555,192 A 9/1925 Dennedy
5,507,627 A 4/1996 Okazaki
6,488,480 B1 12/2002 Zhong

FOREIGN PATENT DOCUMENTS

JP 10-318175 12/1998
JP 11-201060 7/1999
JP 2003-232287 8/2003

OTHER PUBLICATIONS

International Search Report, Apr. 13, 2005.

*Primary Examiner*—Theresa Trieu
(74) *Attorney, Agent, or Firm*—Carlson, Gaskey & Olds

(57) ABSTRACT

A screw compressor is provided with a discharge chamber that receives alternating flows of compressed fluid from two compression chambers located on opposed sides of the screw compressor. The discharge chamber is provided with a central baffle plate separating the two flows. The baffle plate changes the fluid frequency of the system, and ensures that the fluid system will not operate at a frequency that approaches the natural frequency of the overall compressor, thus reducing undesirable vibrations. The baffle plate also reduces the magnitude of the fluctuations and the resultant noise.

10 Claims, 2 Drawing Sheets

COMPRESSOR DISCHARGE CHAMBER WITH BAFFLE PLATE

BACKGROUND OF THE INVENTION

This application relates to the use of a baffle plate separating a compressor discharge chamber into sub-chambers, in the type of compressor having plural cyclically discharging flows.

Many types of compressors are utilized to compress various fluids. In one general type of compressor, the flow of a compressed fluid from the compression chambers occurs cyclically from a plurality of compression chambers. As an example, in a screw compressor having three rotors, there are two compression sets between, with one center screw and each one of the two side screws. These sets periodically discharge a compressed refrigerant into a discharge chamber through discharge ports. The ports are on opposed sides of the discharge chamber. If a single discharge chamber is utilized, there is the potential for cyclic fluctuations in the conditions within the discharge chamber. One example of such a compression discharge structure is disclosed in U.S. Pat. No. 6,488,480, entitled Housing for Screw Compressor.

In such a three-screw compressor, the cyclic discharges create a fluid frequency which approached the natural mechanical frequency of the overall compressor, at compression speeds that were within the expected range of operation speeds for the compressor. When these two frequencies approached each other, unacceptable vibration occurred. Also, the magnitude of fluctuation and resultant noise are undesirably high in this existing compressor.

SUMMARY OF THE INVENTION

In a disclosed embodiment of this invention, a compressor delivers compressed fluid to discharge ports on opposed sides of a discharge chamber centerline. The discharge chamber is provided with a separating baffle plate between the two ports. In a preferred embodiment, the compressor is a three-screw compressor, and the baffle plate is essentially positioned along a centerline of the discharge chamber. In further features, the discharge chamber is somewhat frusto-conical, and necks downs from an upstream position to a downstream position, with the center plate also having this same general necking down feature.

These and other features of the present invention can be best understood from the following specification and drawings, the following of which is a brief description.

DETAILED DESCRIPTION OF THE PREFERRED EMBODIMENT

Figure 1:
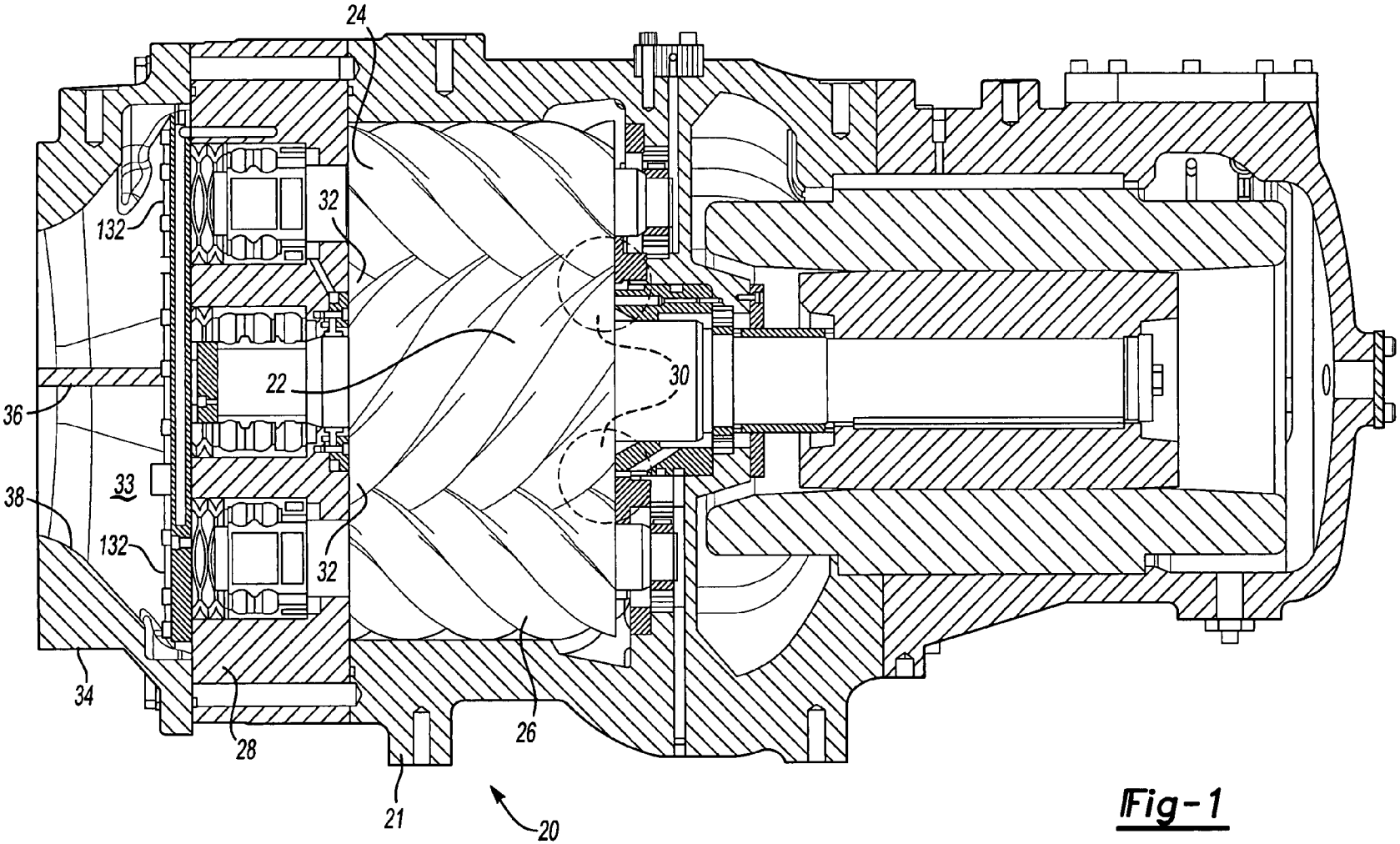
FIG. 1 is a view of a compressor incorporating the present invention.

A compressor 20 is illustrated in FIG. 1 having a housing 21 receiving a central drive screw 22 and two opposed screws 24 and 26. A discharge plate 28 receives compressed refrigerant from compression chambers 32 and delivers this compressed refrigerant through discharge ports in the plate

28 (not shown in FIG. 1) to a discharge chamber 33 in an outlet housing 34. As known, refrigerant is delivered through inlet ports 30, and compressed between the screws 22 and 24 and 22 and 26 toward the discharge ports 132. As shown, a baffle plate 36 is positioned generally in the middle of the discharge chamber 33. The size of the chamber 33 necks down with the inner peripheral surface 38 of the outlet housing 34. As mentioned above, without the baffle plate 36, there has sometimes been undesirable vibration, noise and fluctuations occurring in the compressor 20. The baffle plate 36 serves to change the fluid frequency of the system such that the above-mentioned vibration will not occur during the normal operation range of compressor 20. Also the magnitude of fluctuation and noise are reduced significantly.

Figure 2:
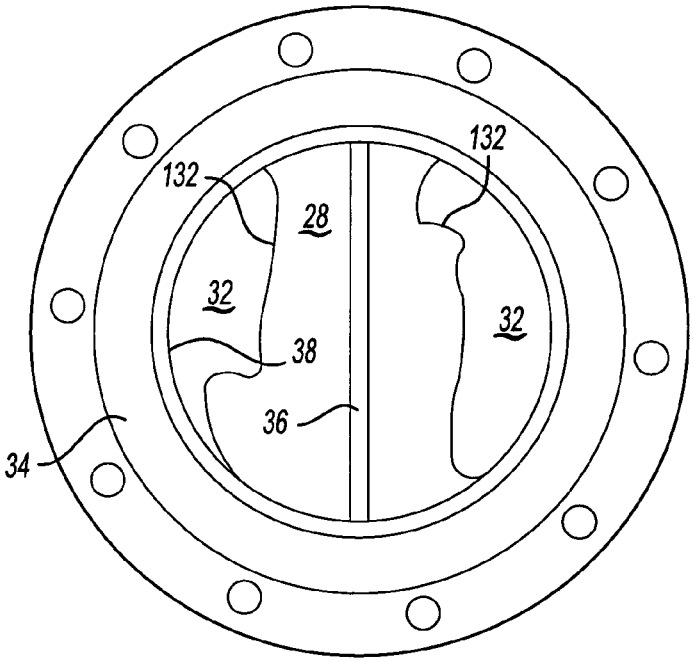
FIG. 2 is an end view of the discharge chamber according to this invention.

As shown in FIG. 2, the baffle plate 36 generally splits the discharge chamber 33 in half. As shown, there are discharge ports 132 which are associated with the compression chambers 32, and which extend through the discharge plate 28 as mentioned above.

Figure 3:
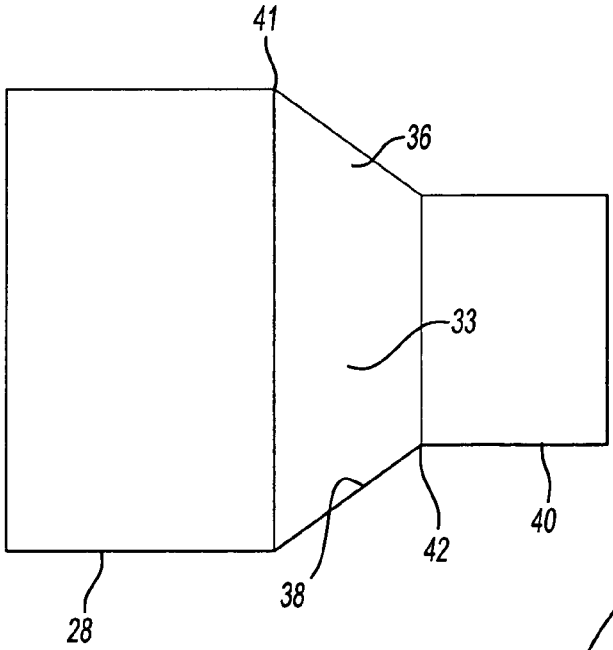
FIG. 3 is a somewhat schematic cross-sectional view.

As shown schematically in FIG. 3, the discharge chamber 33 has plate 36, and the plate 36 has the "necked" or somewhat frusto-conical shape as shown schematically at 38. As shown, an upstream end 41 of the necked portion 38 is attached to the discharge plate 28, and a downstream end 42 is connected to an outlet pipe 40. While FIG. 3 simplifies the shape 38 to be frusto-conical, the actual shape may be generally curved as is better shown in FIG. 1. As can be appreciated from the combination of FIG. 3 and FIG. 1, which are generally perpendicular views relative to each other, the "necking down" of the chamber 33 occurs along both dimensions, and not just in one of the two cross sections.

Figure 4:
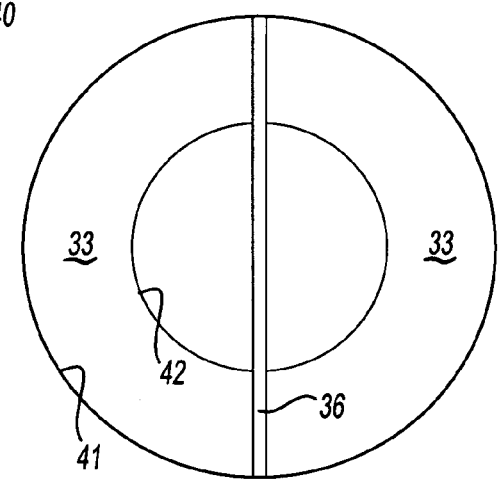
FIG. 4 is a somewhat schematic end view.

FIG. 4 shows the baffle plate 36 bisecting the discharge chamber 33. Now, with the use of the baffle plate 36, the frequency of the fluid flow does not approach the natural frequency of the compressor structure under any expected operation range of the compressor 20. As such, the undesirable vibrations mentioned above should not occur. Also, the magnitude of fluctuations is reduced.

While the invention is most preferably utilized in combination with a screw compressor, other types of compressors having sets of discharge ports on opposed sides of the compressor may also benefit from this invention. Of course, the concept of separating the single discharge chamber through the use of baffle plates can extend to compressors having more than two compression chambers. Further, more than one baffle plate can be utilized even when there are two compression chambers to provide greater control over the fluid frequency.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A compressor comprising:

a compressor pump unit for receiving a fluid to be compressed, and compressing the fluid, said compressor unit having at least two compression chambers, with said two compression chambers delivering a compressed refrigerant into a single discharge chamber defined in a discharge housing; and at least one baffle plate within said discharge chamber and located between said two compression chambers, said two compression chambers each delivering compressed refrigerant to a separate discharge port, each said discharge port extending through a discharge plate, to deliver refrigerant compressed in said compression chambers to a location downstream of said discharge plate, and said baffle plate separating said refrigerant from each of said two compression chambers after said refrigerant has left said discharge ports, and maintaining separation of said refrigerant to a position downstream of said baffle plate.

2. The compressor as set forth in claim 1, wherein said baffle plate generally bisects said discharge chamber.

3. The compressor as set forth in claim 1 wherein said compressor pump unit is a screw compressor with a central drive screw and two side screws, with one of said two compression chambers being defined between said central screw and each of said side screws.

4. The compressor as set forth in claim 1, wherein said discharge chamber is reduced in cross-sectional area from an upstream end adjacent said compression chambers to a downstream end.

5. The compressor as set forth in claim 1, wherein said compression chambers deliver a compressed fluid into said single discharge chamber, with said discharge ports being located on opposed sides of said baffle plate.

6. The compressor as set forth in claim 1, wherein said baffle plate contacts said discharge plate.

7. The compressor as set forth in claim 1, wherein said baffle plate extends generally parallel to a direction of flow through said discharge ports.

8. A compressor comprising:

a screw compressor for receiving a fluid to be compressed, and compressing the fluid, said screw compressor unit having at least two compression chambers, wherein each of said compression chambers are defined between a central drive screw and one of an opposed side screw, said two compression chambers delivering a compressed refrigerant into a single discharge chamber defined in a discharge housing, said compression chambers delivering the compressed fluid through a discharge plate having associated discharge ports and into said single discharge chamber; and a baffle plate within said discharge chamber and located between said two discharge ports, and said baffle plate generally bisecting said discharge chamber.

9. The compressor as set forth in claim 8, wherein said discharge port is reduced in cross-sectional area from an upstream end adjacent said compression chambers to a downstream end.

10. A compressor comprising:

a compressor pump unit for receiving a fluid to be compressed, and compressing the fluid, said compressor unit having at least two compression chambers, with said two compression chambers delivering a compressed refrigerant into a single discharge chamber defined in a discharge housing;

at least one baffle plate within said discharge chamber and located between said two compression chambers; and said compressor pump unit is a screw compressor with a central drive screw and two side screws, with one of said two compression chambers being defined between said central screw and each of said side screws.

* * * * *